United States Patent [19]

Ikeda et al.

[11] 4,329,415

[45] May 11, 1982

[54] MAGNETIC DEVELOPER AND PROCESS FOR PREPARATION THEREOF

[75] Inventors: Toshimitsu Ikeda, Himeji; Nobuyasu Honda, Tenri, both of Japan

[73] Assignee: Mita Industrial Company Limited, Osaka, Japan

[21] Appl. No.: 116,886

[22] Filed: Jan. 30, 1980

[30] Foreign Application Priority Data

Feb. 7, 1979 [JP] Japan ..... 54-12219

[51] Int. Cl.[3] ..... G03G 9/14

[52] U.S. Cl. ..... 430/109; 430/137; 430/903; 430/111

[58] Field of Search ..... 430/106, 107, 109, 110, 430/111, 137, 903; 427/222; 428/403, 407; 106/20, 30

[56] References Cited

U.S. PATENT DOCUMENTS

| | | | |
|---|---|---|---|
| 3,196,032 | 7/1965 | Seymour | 430/109 |
| 3,645,770 | 2/1972 | Flint | 430/122 |
| 4,082,681 | 4/1978 | Takayama et al. | 430/106.6 |
| 4,189,390 | 2/1980 | Noguchi | 430/107 |

FOREIGN PATENT DOCUMENTS

| | | | |
|---|---|---|---|
| 50-140136 | 11/1975 | Japan . | |
| 52-2131 | 8/1977 | Japan | 430/903 |

*Primary Examiner*—Richard L. Schilling
*Assistant Examiner*—John L. Goodrow
*Attorney, Agent, or Firm*—Sherman & Shalloway

[57] ABSTRACT

A composite magnetic developer having a self-friction-chargeability is in the form of fixable magnetic particles having a particle size of 5 to 30 microns and comprising a finely divided magnetic material dispersed in a binder medium which shows an adhesiveness under application of heat and pressure, in which the fixable magnetic particles contain fine particles of a magnetic material embedded in the surface of the fixable magnetic particles in an amount of 1 to 10% by weight based on the fixable magnetic particles and fine particles of a magnetic material adhering to the surface of the fixable magnetic particles without being embedded therein in an amount of 1 to 20% by weight based on the fixable magnetic particles. This developer provides a sharp and clear transfer image having a high density without fogging or edge effects on a transfer sheet having a low electric resistance such as a plain paper. When this developer is used for development of electrostatic latent images, any particular charging operation need not be performed and any carrier need not be used. Even if this developer is used repeatedly for the copying operation, the composition is not substantially changed and good developing characteristics are retained.

13 Claims, 1 Drawing Figure

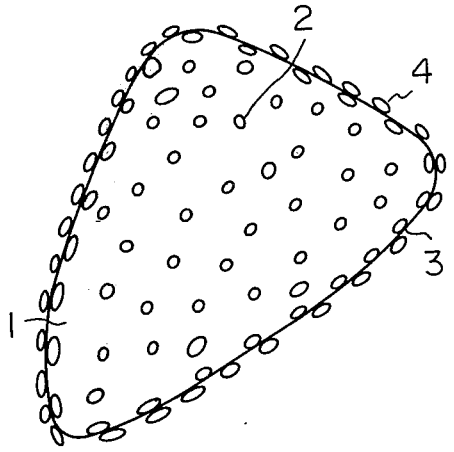
2
4
3
1

MAGNETIC DEVELOPER AND PROCESS FOR PREPARATION THEREOF

BACKGROUND OF THE INVENTION (1) Field of the Invention:

The present invention relates to a magnetic developer having a self-friction-chargeability, and a process for the preparation thereof. More particularly, the present invention relates to a novel composite magnetic developer which can develop an elctrostatic latent image without any particular charging operation to form a developer image that can be transferred onto a plain paper of a low electric resistance without scattering of developer particles (broadening contours of the transferred image) and in which the developer composition can be kept constant at the developing and transferring steps, and a process for the preparation of this novel composite magnetic developer.

(2) Description of the Prior Art:

As the developer capable of developing an electrostatic latent image without using a particular carrier, there are known so-called one-component type magnetic developers comprising a fine powder of a magnetic material incorporated in developer particles.

As one type of such one-component magnetic developer, there is known a so-called conductive magnetic developer in which a find powder of a magnetic material is incorporated in developer particles to render the particles magnetically attractable and a conducting agent such as electrically conductive carbon black is distributed in the surfaces of the particles to impart an electric conductivity to the particles (see, for example, the specifications of U.S. Pat. No. 3,639,245 and U.S. Pat. No. 3,965,022). When this electrically conductive magnetic developer is caused to fall in contact with an electrostatic latent image carried by a supporting plate in the form of a magnetic brush to effect development, an excellent visible image free of so-called edge effects or fogs can be obtained. However, it is known that when an image of the developer is transferred onto an ordinary transfer sheet from the supporting plate, there arises a serious problem. More specifically, as described in Japanese Patent Application Laid-Open Specification No. 117435/75, when a transfer sheet having a resistivity lower than $3\times10^{13}$ Ω-cm, such as plain paper, is used, it often happens that at the transferring step, developer particles are scattered to cause broadening of contours of the transferred images or reduction of the transfer efficiency. This undesirable tendency may be moderated to some extend by coating a toner-receiving surface of a transfer sheet with a resin, wax or oil having a high electric resistance, but this improving effect is reduced under high humidity conditions. Furthermore, the cost of transfer sheets is increased by coating of such resin or the like and the touch or feel of transfer sheets is degraded.

As another type of the one-component type magnetic developer, there is known a one-component type non-conductive magnetic developer consisting essentially of particles of a homogeneous intimate mixture of a finely devided magnetic material and an electricity-detecting binder. For example, the specification of U.S. Pat. No. 3,645,770 discloses an electrostatic photographic reproduction process in which a magnetic brush (layer) of the above-mentioned non-conductive magnetic developer is charged by corona discharge to a polarity reverse to the polarity of an electrostatic latent image to be developed, the charged developer is caused to fall in contact with the electrostatic latent image carried by a supporting plate to develop the electrostatic latent image and the so-formed developer image is transferred onto a transfer sheet. This electrostatic photographic reproduction process is advantageous in that a developed image can be transferred onto a so-called plain paper or a similar transfer sheet, but this process still involves some defects. For example, it is ordinarily difficult to uniformly charge the magnetic brush of the non-conductive magnetic developer and the deep portion of the magnetic brush is not sufficiently charged, and it also is difficult to form an image having a sufficiently high image density. Furthermore, since a corona discharge mechanism has to be disposed in the developing zone, the structure of the copying apparatus becomes complicated.

Recently, there have been proposed a process in which an electrostatic latent image is developed by utilizing charging of a non-conductive magnetic developer caused by friction between the developer and the surface of an electrostatic latent image-supporting plate (see Japanese Patent Application Laid-Open Specification No. 62638/75) and a process in which development is accomplished by utilizing dielectric polarization of a non-conductive magnetic developer (see Japanese Patent Application Laid-Open Specification No. 133026/76). These processes, however, are still insufficient.

In the former process, for example, the development conditions should be controlled very strictly. If the development conditions are not strictly controlled, fogging is readily caused in non-image areas (fogging is especially prominent when the degree of mutual contact between the surface of a photosensitive material and the top ends of spikes of toner particles is high), and such troubles as adhesion of the magnetic toner particles to a developing sleeve and blocking of the toner particles are caused. These troubles are especially serious when the copying operation is carried out continuously.

In the latter process, though fogging is not caused to occur, since a visible image is formed from an electrostatic latent image by a developing charge obtained by the dielectric polarizing effect induced in the magnetic toner, a latent image area of a low potential is not sufficiently developed. Accordingly, a low-density area of an original is not sufficiently reproduced in an obtained copy and a half-tone cannot be sufficiently reproduced according to this process.

Moreover, prints obtained according to these two process are poor in the image sharpness, and when a p-type photosensitive material such as selenium is used, images having a sufficiently high density can hardly be obtained according to these processes.

Magnetic developers hving a self-friction-chargeability have already been proposed. For example, Japanese Patent Application Laid-Open Specifications No. 35546/78 and No. 33152/78 disclose that a mixture of conductive magnetic toner particles with insulating non-magnetic toner particles or insulating magnetic toner particles is used as a developer. These composite magnetic developers have such a property that they are charged by friction among particles. Namely, they have a self-friction-chargeability. These composite magnetic developers are advantageous in that images of these developers can be transferred onto plain papers. However, in these developers, the composition suitable for frictional self-charging is changed while the developer is being actually used for formation of developer images, and therefore, in order to maintain a good balance in the developer composition, the composition should be adjusted during the use as in case of conventional two-component type developers.

SUMMARY OF THE INVENTION

It is therefore a primary object of the present invention to provide a novel composite magnetic developer having a high self-friction-chargeability, retaining a good composition balance during the use and being capable of providing a transfer image having a high density and a process for the preparation of this novel composite magnetic developer.

Another object of the present invention is to provide a composite magnetic developer capable of developing an electrostatic latent image without any particular charging operation and providing a transfer image without broadening of contours even on a plain paper having a low electric resistance, in which changes of the developer composition are prevented during the developing and transferring operations, and a process for the preparation of this composite magnetic developer.

Still another object of the present invention is to provide a novel process in which a novel composite magnetic developer having the above-mentioned characteristics can be prepared very easily without any troublesome operation.

In accordance with the present invention, there is provided a composite magnetic developer having a self-friction-chargeability, which comprises fixable magnetic particles having a particle size of 5 to 30 microns and comprising a finely divided magnetic material dispersed in a binder medium which shows an adhesiveness under application of heat and pressure, and fixable magnetic particles containing fine particles of a magnetic material embedded in the surfaces of said fixable magnetic particles in an amount of 1 to 10% by weight based on said fixable magnetic particles and fine particles of a magnetic material adhering to the surfaces of said fixable magnetic particles without being embedded therein in an amount of 1 to 20% by weight based on said fixable magnetic particles.

BRIEF DESCRIPTION OF THE FIGURE

FIG. 1 is a sectional view illustrating diagrammatically the composite developer of the present invention, in which reference numeral 1 represents a binder medium of fixable magnetic particles, reference numeral 2 represents a finely divided magnetic material dispersed in the binder medium 1, reference numeral 3 represents fine particles of a magnetic material embedded in the surfaces of the fixable magnetic particles, and reference numeral 4 represents fine particles of a magnetic material adhering to the surfaces of the fixable magnetic particles without being embedded therein.

DETAILED DESCRIPTION OF THE PREFERRED EMBODIMENTS

A most important feature of the composite magnetic developer of the present invention is that fine particles of a magnetic material are embedded in the surfaces of fixable magnetic particles in an amount of 1 to 10% by weight, particularly 1 to 5% by weight, based on the fixable magnetic particles (all of "%" and "parts" in the instant specification are by weight unless otherwide indicated), and fine particles of a magnetic material are present in the state adhering to the surface of the fixable magnetic particles without being embedded therein, that is, in the state sprinkled on the surfaces of the fixable magnetic particles, in an amount of 1 to 20%, particularly 3 to 15%, based on the fixable magnetic particles. In the composite magnetic developer of the present invention, fine particles of a magnetic material adhering to the surfaces of the fixable magnetic particles without being embedded therein (sometimes called "sprinkled fine particles") act as a so-called carrier in a developer tank or developing sleeve and by the action of the sprinkled particles, frictional self-charging of the developer can be effectively accomplished prior to development of an electrostatic latent image. In the composite magnetic developer of the present invention, since the fine particles of a magnetic material acting as the carrier are uniformly present on the surfaces of the fixable magnetic particles in the state adhering thereto, the fixable magnetic particles are strongly charged uniformly, and therefore, a sharp and clear developer image having a high density can be obtained without fogging.

Furthermore, in the composite magnetic developer of the present invention, there can be attained an unexpected advantage that at the developing and transferring steps, all the sprinkled fine particles present on the surfaces of the fixable magnetic particles act as a toner. More specifically, in the composite magnetic developer of the present invention, fine particles of a magnetic material embedded in the surfaces of the fixable magnetic particles (sometimes called "embedded fine particles") are inevitably present, and since the developer is subject to the influence of a magnet when the developer is drawn up by the developing sleeve, the fixable magnetic particles have a strong influence of the residual magnetism on the sprinkled fine particles. Accordingly, in the composite developer of the present invention, development and transfer are conducted in the state where the sprinkled fine particles are attracted to the fixable magnetic particles, and therefore, even if the developer of the present invention is used for a long time, the original composition is not changed.

In the developer of the present invention, the sprinkled fine particles composed of a magnetic material act as a carrier prior to the development, and at the developing step, the sprinkled fine particles are always moved together with the fixable magnetic particles by the action of the residual magnetism of the embedded fine particles composed of a magnetic material, and therefore, a good balance is maintained in the composition of the developer.

In the composite developer of the present invention, some of fine particles of a magnetic material are distributed predominantly in the form of embedded fine particles in the surfaces of the fixable magnetic particles and the remaining fine particles are present on the surfaces of the fixable magnetic particles in the form of sprinkled fine particles. By virtue of this characteristic feature, the property of being magnetically attracted is very strong in the developer of the present invention. Accordingly, an image having a high contrast can be formed without fogging, and there is attained an additional advantage that the residual developer of the magnetic brush can easily be removed from the photosensitive surface after the transferring operation.

When the amount of the embedded fine particles is smaller than 1% based on the fixable magnetic particles, it becomes difficult to move the sprinkled fine particles together with the fixable magnetic particles at the developing step, and the composition of the developer is changed. When the amount of the embedded fine particles is larger than 10% of the fixable magnetic particles, the surface resistivity of the fixable magnetic particles is reduced and the particles are not sufficiently charged.

When the amount of the sprinkled fine particles is smaller than 1%, the self-friction-chargeability of the developer is reduced, and when the amount of the sprinkled fine particles is larger than 20%, some of sprinkled fine particles are not moved together with the fixable magnetic particles at the developing step and the composition of the developer is gradually changed.

In the composite magnetic developer of the present invention, a fine powder of a magnetic material having a weight average particle size smaller than 2 microns and a volume resistivity lower than $10^{10}$ Ω-cm is preferred as the sprinkled fine particles. More specifically, the finer is the particle size of the sprinkled fine particles, the larger is the force by which the sprinkled fine particles are retained on the fixable magnetic particles, and the lower is the volume resistivity, the more stabilized are the charging characteristics of the fixable magnetic particles, with the result that the amount used of the sprinkled fine particles can be reduced. Any of known magnetic materials can be used for the sprinkled fine particles, but triiron tetroxide ($Fe_3O_4$) is ordinarily preferred.

The same fine powder of a magnetic material as that for the sprinkled fine particles can be used for the embedded fine particles, or when the two-staged preparation process described hereinafter is adopted, a fine powder of a magnetic material different from that for the sprinkled fine particles may be used for the embedded fine particles. From the viewpoint of the charging characteristics of the fixable magnetic particles, it is preferred that the volume resistivity of the embedded fine particles be as high as possible. Accordingly, it is recommended to use a fine powder of a magnetic material having a volume resistivity of at least $10^7$ Ω-cm.

Accordingly, it will readily be understood that when a fine powder of a magnetic material having a volume resistivity of $10^7$ to $10^{10}$ Ω-cm, especially a fine powder of triiron tetroxide, is selected, this fine powder may be used for both the embedded fine particles and the sprinkled fine particles.

In order to prevent agglomeration in the final composite developer of the present invention and improve the flowability thereof, dry-method finely divided silica such as Aerosil may be incorporated in an amount of 0.1 to 1%, particularly 0.2 to 0.6%, based on the fixable magnetic particles in addition to the above-mentioned finely divided magnetic material.

In the developer of the present invention, any of known finely divided magnetic materials can be used as the finely divided magnetic material to be dispersed in the binder medium and the particle size or volume resistivity is not particularly critical. Of course, this finely divided magnetic material may be the same as or different from the magnetic material for the sprinkled or embedded fine particles.

The binder medium which is present in the form of a dispersion medium in the fixable magnetic particles shows an adhesiveness under application of heat and pressure. Any of materials having this property can be used as the binder medium in the present invention. For example, waxes, resins and rubbers having such property can be used singly or in the form of a mixture of two or more of them, As the wax, there may be used, for example, vegetable waxes such as cotton wax and carnauba wax, animal waxes such as wool wax, bees wax and whale wax, mineral waxes such as montan wax and ceresine, petroleum waxes such as paraffin wax and microcrystalline wax, and synthetic waxes such as polyethylene wax, polypropylene wax, oxidized polyethylene wax, higher fatty acids, esters, amides and soaps of higher fatty acids, higher alcohols, polyethylene glycol and polypropylene glycol. As the resin, there can be used, for example, thermoplastic resins such as styrene resins, acrylic resins, polyamides, polyesters and vinyl resins, and thermosetting resins such as epoxy resins, phenolic resins, alkyd resins, amino resins and urethane resins. As the rubber, there can be used, for example, polybutadiene, nitrile rubber, styrene rubber, ethylene-propylene rubber and butyl rubber.

In the present invention, in order to impart a preferred combination of the self-charging characteristic and fixing property to the fixable magnetic particles, it is preferred that the binder medium be used in an amount of 50 to 200%, particularly 60 to 125%, based on the finely divided magnetic material.

In order to control the charging polarity of the fixable magnetic particles, a known charge controlling agent may be incorporated into the binder medium according to need. For example, an oil-soluble dye such as Oil Black or Oil Blue may be used as the agent for controlling the charging polarity to a positive polarity, and a metal-containing dye such as a chromium complex dye of C.I. Acid Black 123 can be used as the agent for controlling the charging polarity to a negative polarity. Furthermore, a pigment such as carbon black or a dye such as Nigrosine may be incorporated as a coloring agent for coloring the fixable magnetic particles or improving the hue thereof.

In the electrostatic photographic process in which the copying operation is repeated while transferring developed images to transfer sheets such as plain papers from an electrostatic photosensitive layer, in order to prevent formation of ozone and degradation of the photosensitive layer by ozone, it is preferred that an electrostatic latent image be an image of charges of a positive polarity. From this viewpoint, in the composite developer of the present invention, it is preferred that the fixable magnetic particles have such a charging characteristic that they are negatively charged.

From the above-mentioned viewpoint, in the composite developer of the present invention, it is preferred that at least 50%, particularly at least 60%, of the binder medium be at least one member selected from aromatic vinyl polymers and polyolefin waxes. More specifically, in accordance with one preferred embodiment of the present invention, there is provided a composite developer excellent in the property of being frictionally charged to a negative polarity and also excellent in the combination of the fixing property and flowability, in which the binder medium of the fixable magnetic particles comprises 1 to 190%, particularly 1.6 to 160%, based on the finely divided magnetic material, of an aromatic vinyl polymer, 0 to 60%, particularly 0 to 50%, based on the finely divided magnetic material, of an alicyclic resin or nonaromatic petroleum resin and 2 to 160%, particularly 3.2 to 135%, based on the finely divided magnetic material, of a polyolefin wax.

As the aromatic vinyl monomer (a) constituting the aromatic vinyl polymer, there can be mentioned monomers represented by the following general formula:

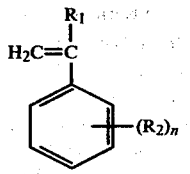

wherein $R_1$ stands for a hydrogen atom, a lower alkyl group (an alkyl group having up to 4 carbon atoms) of a halogen atom, $R_2$ stands for a lower alkyl group, a halogen atom or other substituent, and n is an integer of up to 2, inclusive of zero, such as styrene, vinyltoluene, α-methylstyrene, α-chlorostyrene, vinylxylene and vinylnaphthalene. Among these monomers, styrene and vinyltoluene are especially preferred.

Styrene or vinyltoluene may be used in the form of a homopolymer or a copolymer.

As preferred examples of the monomer (b) other than the aromatic vinyl monomer (a), there can be mentioned acrylic monomers represented by the following general formula:

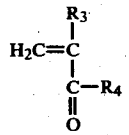

wherein $R_3$ stands for a hydrogen atom or a lower alkyl group, and $R_4$ stands for a hydroxyl group, an alkoxy group, a hydroxyalkoxy group or an aminoalkoxy group, such as acrylic acid, methacrylic acid, ethyl acrylate, methyl methacrylate, butyl acrylate, butyl methacrylate, 2-ethylhexyl acrylate, 2-ethylhexy methacrylate, 3-hydroxypropyl acrylate, 2-hydroxyethyl methacrylate, 3-aminopropyl acrylate, 3-N,N-diethylaminopropyl acrylate and acrylamide, and conjugated diolefin monomers represented by the following general formula:

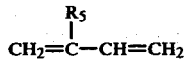

wherein $R_5$ stands for a hydrogen atom, a lower alkyl group or a chlorine atom, such as butadiene, isoprene and chloroprene.

In addition to the above-mentioned monomers, there may be used ethylenically unsaturated carboxylic acids such as maleic anhydride, fumaric acid, crotonic acid and itaconic acid, esters of these ethylenically unsaturated acids, vinyl esters such as vinyl acetate, and vinylpyridine, vinylpyrrolidone, vinyl ethers, acrylonitrile, vinyl chloride and vinylidene chloride.

It is preferred that the weight average molecular weight of the aromatic vinyl polymer be in the range of from 1,000 to 100,000.

As the alicyclic resin, there can be mentioned hydrogenated aromatic vinyl resins such as hydrogenated styrene resins, hydrogenated vinyltoluene resins, and terpene resins. The degree of hydrogenation may be 30 to 100%, particularly 50 to 100%, in the hydrogenated aromatic vinyl resin. Preferred hydrogenated aromatic vinyl resins are marketed under the tradenames of Arcon P-125 and Arcon M-95 (manufactured by Arakawa Rinsan Kabushiki Kaisha) and are easily available. Terpene resins include natural and synthetic polymers of terpene hydrocarbons. A product obtained by polymerizing a terpentine or nopinene fraction in the presence of a Friedel-Crafts catalyst such as aluminum chloride is preferably used.

As the non-aromatic petroleum resin, there may be used petroleum resins obtained by using a higher olefinic hydrocarbon as the main starting material.

As the polyolefin wax, there may be used polyethylene wax, polypropylene wax, an ethylene-propylene copolymer wax and mixtures thereof.

The fixable magnetic particles that are used for the composite developer of the present invention have a particle size of 5 to 30 microns, preferably 8 to 25 microns.

The composite magnetic developer of the present invention may be prepared according to a process comprising forming fixable magnetic particles having a particle size of 5 to 30 microns and comprising a finely divided magnetic material dispersed in a binder medium showing an adhesiveness under application of heat and pressure, dry-blending 2 to 30% by weight, based on the fixable magnetic particles, of fine particles of a magnetic material into the fixable magnetic particles while agitating the fixable magnetic particles and the fine particles of the magnetic material at a high speed under such conditions that the surfaces of the fixable magnetic particles are softened by heat of friction, and thereby embedding the fine particles of the magnetic material in an amount of 1 to 10% by weight based on the fixable magnetic particles in the surfaces of the fixable magnetic particles.

The above-mentioned fixable magnetic particles may be used according to a known method, but in order to effectively embed fine particles of a magnetic material, to be dry-blended, in the surfaces of the fixable magnetic particles, it is preferred to use fixable magnetic particles prepared by kneading a finely divided magnetic material with a binder medium, cooling and pulverizing the kneaded mixture and classifying the resulting particles. More specifically, the particles prepared according to this method have an indeterminate shape and when they are agitated at a high speed, heat of friction is generated to soften the surfaces of the particles and fine particles of the magnetic material dry-blended can be effectively embedded in the surfaces of the particles.

The so prepared fixable magnetic particles are dry-blended with fine particles of a magnetic material at the above-mentioned weight ratio. This dry blending may be performed in two stages or in one stage.

In accordance with one embodiment of the process of the present invention, the above-mentioned dry blending is performed in two stages in such a manner that by the first high speed agitation treatment, fine particles of the magnetic material are embedded in the surfaces of the fixable magentic particles in an amount of 1 to 10% by weight based on the fixable magnetic particles and by the subsequent mixing treatment, fine particles of the magnetic material are blended with the fixable magnetic particles without being embedded therein in an amount of 1 to 20% by weight based on the fixable magnetic particles.

The high speed agitation treatment can easily be accomplished by using a Henschel mixer. The agitation time for embedding fine particles of the magnetic material in the surfaces of the fixable magnetic particles varies depending on the heating temperature and agitation speed of the Henschel mixer. For example, when the Henschel mixer is heated, the agitation time can be remarkably shortened as compared with the agitation time necessary when the agitation is conducted at room temperature. However, adoption of a high temperature at which agglomeration or coagulation of the fixable magnetic particles takes place should be avoided. It is ordinarily preferred that the high speed agitation treatment be carried out at a temperature ranging from room temperature to 60° C., particularly at an elevated temperature of up to 50° C. From the viewpoint of the operation facility, it is preferred that the agitation speed be 500 to 5,000 r.p.m., especially 1,000 to 3,000 r.p.m. The treatment is conducted for at least 5 minutes, particularly at least 10 minutes, and an appropriate treatment time sufficient to embed fine particles of the magnetic material in the surfaces of the fixable magnetic material is determined by experiments.

In the present invention, whether or not fine particles of the magnetic material are embedded in the surfaces of the fixable magnetic particles can easily be confirmed by dispersing the product obtained by the high speed agitation treatment in an aqueous solution of a surface active agent, dropping the dispersion on a preparation glass, drying the dispersion and observing the dry product by a microscope. When there are present unembedded free fine particles of the magnetic material in the treatment product, at the step of drying the abovementioned dispersion such free fine particles of the magnetic material agglomerate. Accordingly, the presence of such free particles of the magnetic material can easily be confirmed.

At the high speed agitation treatment of the first stage, embedding of fine particles of the magnetic material in the surfaces of the fixable magnetic particles is effectively accomplished, and the fixable magnetic particles having an indeterminate shape are somewhat rounded at the edges thereof and an optimum combination of the flowability and transferability can be attained in the fixable magnetic particles.

The dry blending treatment of the second stage is performed to sprinkle fine particles of the magnetic material uniformly around peripheries of the fixable magnetic particles without being embedded therein. Ordinarily, the intended effect can be attained by performing the dry blending treatment for 2 to 3 minutes.

In accordance with another embodiment of the process of the present invention, the dry blending is performed in one stage and the high speed agitation treatment is stopped at the point when 1 to 10% by weight, based on the fixable magnetic particles, of fine particles of the magnetic material are embedded in the surfaces of the fixable magnetic particles and 1 to 20% by weight, based on the fixable magnetic particles, of fine particles of the magnetic material are not embedded in the surfaces of the fixable magnetic particles. In this embodiment, a necessary amount of fine particles of the magnetic material, that is, 2 to 30% of fine particles of the magnetic material, are incorporated at a time into the fixable magnetic particles and the agitation treatment is carried out for a predetermined time. This agitation time can easily be determined. Namely, the relation between the treatment time and the amount of fine particles of the magnetic material embedded at certain temperature and agitation speed is experimentally determined and the treatment time is decided based on this relation so that a predetermined amount of fine particles of the magnetic material are embedded in the surfaces of the fixable magnetic particles.

As pointed out hereinbefore, the magnetic developer of the present invention has a good self-friction-chargeability and an excellent composition-retaining property. Furthermore, the magnetic developer of the present invention is excellent in the property of being attracted by a magnet and has a desirable combination of the flowability and transferability. Accordingly, when the magnetic developer of the present invention is used, there is obtained a clear and sharp transferred image having a high density without fogs or other contamination of the background. Moreover, there is attained a prominent advantage that cleaning of the photosensitive layer can be accomplished very easily.

Therefore, the magnetic developer of the present invention can be advantageously applied to the electroastatic photographic reproduction process of the type in which an electrostatic latent image of a positive polarity is developed and the resulting developer image is transferred onto a plain paper and fixed thereon.

The present invention will now be described in detail with reference to the following Examples that by no means limit the scope of the invention.

EXAMPLE 1

| | |
|---|---|
| Pliolite VTL (polyvinyltoluene manufactured by Goodyear Tire & Rubber Co.) | 25 parts by weight |
| Viscol 550P (polypropylene manufactured by Sanyo Kasei Kabushiki Kaisha) | 35 parts by weight |
| Sanwax 131P (polyethylene manufactured by Sanyo Kasei Kabushiki Kaisha) | 40 parts by weight |
| Triiron tetroxide (Black Iron B6 manufactured by Toyo Shikiso Kabushiki Kaisha; average particle size = 0.6 μ) | 100 parts by weight |

The above materials were mixed and kneaded by a hot two-roll mill, and the kneaded mixture was cooled and pulverized by using a pin mill and a jet mill in combination. Particles having a particle size of 5 to 30μ were collected by using a classifying sieve. In a Henschel mixer (Heat Mixer Model FM 10B manufactured by Mitsui Miike Seisakusho), 2 Kg of the so obtained fixable magnetic particles having a particle size of 5 to 30μ and 60 g of triiron tetroxide (Black Iron B6) were charged and agitation was carried out at 1,500 r.p.m. for 30 minutes while maintaining the inner temperature of the mixer at 50° C. to embed triiron tetroxide in the surfaces of the fixable magnetic particles. Then, by using the cooled Henschel mixer, 100 g of triiron tetroxide (Black Iron B6) was dry-blended in the fixable magnetic particles by carrying out agitation at 1,000 r.p.m. for 2 minutes to obtain a magnetic developer.

The following 6 comparative magnetic developers were prepared by using the above-mentioned fixable magnetic particles having a particle size of 5 to 30μ, which had been used for the preparation of the above magnetic developer of Example 1.

COMPARATIVE SAMPLE 1

In the Henschel mixed maintained at 50° C., 2 Kg of the fixable magnetic particles of Example 1 having a particle size of 5 to 30μ and 160 g of triiron teroxide (Black Iron B6) were charged, and agitation was carried out at 1,500 r.p.m. for 30 minutes to embed all the triiron tetroxide in the surfaces of the fixable magnetic particles and obtain a magnetic developer. Even if this developer was classified , the untreated triiron tetroxide was not separated at all.

COMPARATIVE SAMPLE 2

In the cooled Henschel mixer, 2 Kg of the fixable magnetic particles of Example 1 having a particle size of 5 to 30μ and 160 g of triiron tetroxide (Black Iron B6) were charged, and agitation was carried out at 1,000 r.p.m for 2 minutes to obtain a magnetic developer. When this developer was classified, the triiron tetroxide was separated.

COMPARATIVE SAMPLE 3

In the same manner as described in Example 1, 60 g of triiron tetroxide (Black Iron B6) was embedded in the surfaces of 2 Kg of the fixable magnetic particles having a particle size of 5 to 30μ, and in the cooled Henschel mixer, 10 g of triiron tetroxide (Black Iron B6) was incorporated in the fixable magnetic particles and agitation was carried out at 1,000 r.p.m. for 2 minutes to obtain a magnetic developer.

COMPARATIVE SAMPLE 4

In the same manner as described in Example 1, 60 g of triiron tetroxide (Black Iron B6) was embedded in the surfaces of 2 Kg of the fixable magnetic particles having a particle size of 5 to 30μ, and in the cooled Henschel mixer, 600 g of triiron tetroxide (Black Iron B6) was incorporated in the fixable magnetic particles and agitation was carried out at 1,000 r.p.m. for 2 minutes to obtain a magnetic developer.

COMPARATIVE SAMPLE 5

In the same manner as described in Example 1, 10 g of triiron tetroxide (Black Iron B6) was embedded in the surfaces of 2 Kg of the fixable magnetic particles having a particle size of 5 to 30μ, and in the cooled Henschel mixer, 100 g of triiron tetroxide (Black Iron B6) was incorporated in the fixable magnetic particles and agitation was carried out at 1,000 r.p.m. for 2 minutes to obtain a magnetic developer.

COMPARATIVE SAMPLE 6

In the same manner as described in Example 1, 200 g of triiron tetroxide (Black Iron B6) was embedded in the surfaces of 2 Kg of the fixable magnetic particles having a particle size of 5 to 30μ, and in the cooled Henschel mixer, 100 g of triiron tetroxide (Black Iron B6) was incorporated in the fixable magnetic particles and agitation was carried out at 1,000 r.p.m. for 2 minutes to obtain a magnetic developer.

The magnetic developer of Example 1 and the comparative samples 1 to 6 were tested in an electrophotographic copying machine in which an organic photosensitive material was used and images were formed by the operation cycle of positive charging-imagewise exposure-development-transfer-whole surface exposure-cleaning. Incidentally, development was performed according to the magnetic brush development method and the cleaning operation was conducted in the developing zone. The transferred image was fixed by the pressure fixing method. The obtained results are shown in Table 1.

TABLE 1

| | Samples | | | | | | |
|---|---|---|---|---|---|---|---|
| | | Comparative Samples | | | | | |
| Test Items | Example 1 | 1 | 2 | 3 | 4 | 5 | 6 |
| Image Density of First Print | 1.62 | 0.52 | 1.45 | 0.65 | 0.42 | 1.58 | 0.62 |
| Fog Density of First Print | 0.04 | 0.05 | 0.12 | 0.08 | 0.15 | 0.08 | 0.08 |
| Cleaning of Photosensitive Plate after Transfer | ○ | X | Δ | X | Δ | Δ | Δ |
| Image Density of 500th Print | 1.60 | no image, entire surface blackened | 0.72 | no image, entire surface blackened | 0.38 | no image, entire surface blackened | 0.31 |
| Fog Density of 500th Print | 0.04 | — | 0.08 | — | 0.15 | — | 0.08 |

Note
(1) The density of each print was measured by a densitometer (Sakura Densitometer Model PDA manufactured by Konishiroku Shashin Kogyo Kabushiki Kaisha).
(2) Symbols on the Table have the following meaning:
○: good
Δ: relatively bad
X: bad With respect to the sample of Example 1 and comparative samples 2, 4 and 6, changes of the developer composition were examined after 500 prints had been obtained. Namely, after 500 prints had been obtained, the weight ratio of the fixable magnetic particles to the blended triiron tetroxide was examined by dispersing the sample in an aqueous solution of a surface active agent, dropping the dispersion on a preparation glass, drying the dispersion and observing the dry product by a microscope. The observation result was compared with the result of the observation made in the same manner before the start of the copying operation. The obtained results are as shown below.

Example 1:

No change of the composition was observed.

Comparative Sample 2:

The ratio of the blended triiron tetroxide was increased.

Comparative Sample 4:

The ratio of the blended triiron tetroxide was increased.

Comparative Sample 6:

Slight increase of the ratio of the blended triiron tetroxide was observed.

EXAMPLE 2

| | |
|---|---|
| Pliolite VTL | 20 parts by weight |
| Arcon P-125 (alicyclic resin manufactured by Arakawa Rinsan Kabushiki Kaisha) | 25 parts by weight |
| Sanwax 161P (polyethylene manufactured by Sanyo Kasei Kabushiki Kaisha) | 55 parts by weight |
| Triiron tetroxide (RB-BL manufactured by Titan Kogyo Kabushiki Kaisha; average particle size = 0.8 μ) | 120 parts by weight |

The above-mentioned materials were kneaded by a hot two-roll mill, and the kneaded mixture was cooled and pulverized by using a pin mill and a jet mill in combination. Particles having a particle size of 10 to 25μ were collected by using a classifying sieve. In a Henschel mixer (Model FM 10B), 2 Kg of the so obtained fixable magnetic particles having a particle size of 10 to 25μ and 240 g of triiron tetroxide (BL-500 manufactured by Titan Kogyo Kabushiki Kaisha; average particle size=0.4μ) were charged and agitation was carried out at 1,500 r.p.m. for 10 minutes while maintaining the inner temperature of the mixer at 50° C. to embed some of the triiron tetroxide in the surface of the fixable magnetic particles. Then, the particles were transferred into the cooled mixer and 10 g of powdery silica was added and agitation was carried out at 1,000 r.p.m. for 3 minutes to obtain a magnetic developer.

By using the so obtained magnetic developer, the copying operation was carried out in the same manner as in Example 1 except that selenium was used as the photosensitive material. The obtained results were substantially the same as those obtained in Example 1.

EXAMPLE 3

| | |
|---|---|
| Piccolastic D-125 (polystyrene manufactured by Esso Standard Oil Co.) | 93 parts by weight |
| Viscol 550P | 7 parts by weight |
| Triiron tetroxide (KN-320 manufactured by Toda Kogyo Kabushiki Kaisha; average particle size = 0.5 μ) | 80 parts by weight |

The above-mentioned materials were kneaded by using a hot two-roll mill, and the kneaded mixture was cooled and pulverized by using a pin mill and a jet mill in combination. Particles having a particle size of 15 to 30μ were collected by using a classifying sieve. In a Henschel mixer (Model FM 10B), 2 Kg of the so obtained fixable magnetic particles having a particle size of 15 to 30μ and 60 g of triiron tetroxide (KN-320) were charged, and agitation was carried out at 2,500 r.p.m. for 40 minutes while maintaining the inner temperature of the mixer at 50° C. The mixture was cooled and 120 g of triiron tetroxide (KN-320) was further added, and agitation was carried out at 1,000 r.p.m. for 3 minutes to obtain a magnetic developer.

By using the so obtained developer, the copying operation was carried out in the same manner as in Example 1. The obtained results were substantially the same as those obtained in Example 1. Incidentally, fixing of the transferred image was conducted by the thermal fixation method.

What is claimed is:

1. A composite magnetic developer having a self-friction-chargability, which comprises fixable magnetic particles having a particle size of 5 to 30 microns and comprising (A) fine particles of triiron tetroxide dispersed in (B) a binder medium which shows an adhesiveness under application of heat and pressure, said fixable magnetic particles containing (C) fine particles of triiron tetroxide embedded in the surfaces of said fixable magnetic particles in an amount of 1 to 10% by weight based on said fixable magnetic particles and (D) fine particles of triiron tetroxide adhering to the surfaces of said fixable magnetic particles without being embedded therein in an amount of 1 to 20% by weight based on said fixable magnetic particles.

2. A composite magnetic developer as set forth in claim 1 wherein the fine particles (D) of triiron tetroxide have a weight average particle size smaller than 2 microns and a volume resistivity lower than $10^{10}$ Ω-cm.

3. A composite magnetic developer as set forth in any of claims 1 or 2 wherein the amount of the fine particles of triiron tetroxide embedded in the surfaces of the fixable magnetic particles (C) is 1 to 5% by weight and the amount of the fine particles of triiron tetroxide adhering to the surfaces of the fixable magnetic particles without being embedded therein (D) is 3 to 15% by weight, based on the fixable magnetic particles.

4. A composite magnetic developer as set forth in claim 1 wherein the binder medium (B) is at least one member selected from the group consisting of waxes, resins and rubbers and the amount of the binder medium is 50 to 200% by weight based on the fine particles of triiron tetroxide material (A) in the fixable magnetic particles.

5. A composite magnetic developer for developing positively charged images as set forth in claim 1 or 4 wherein the binder medium (B) comprises 1 to 190% by weight, based on the fine particles of triiron tetroxide material (A) of the fixable magnetic particles, of an aromatic vinyl polymer, 0 to 60% by weight, based on the fine particles of triiron tetroxide material (A) of the fixable magnetic particles, of an alicyclic resin or non-aromatic petroleum resin and 2 to 160% by weight, based on the fine particles of triiron tetroxide material (A) of the fixable magnetic particles, of a polyolefin wax.

6. A process for the preparation of a composite magnetic developer as set forth in claim 1, which comprises forming fixable magnetic particles having a particle size of 5 to 30 microns and comprising fine particles of triiron tetroxide dispersed in a binder medium which shows an adhesiveness under application of heat and pressure, dry blending 2 to 30% by weight, based on said fixable magnetic particles, of fine particles of triiron tetroxide into said fixable magnetic particles while agitating the fixable magnetic particles and the fine particles of triiron tetroxide at a high speed under such conditions that the surfaces of the fixable magnetic particles are softened by heat of friction, and thereby embedding the fine particles of triiron tetroxide in an amount of 1 to 10% by weight based on the fixable magnetic particles in the surfaces of the fixable magnetic particles.

7. A process according to claim 6 wherein said fixable magnetic particles are formed by kneading the fine particles of triiron tetroxide with the binder medium, cooling the kneaded mixture, pulverizing the mixture and sieving the resulting particles.

8. A process according to claim 6 wherein the dry blending is performed in two stages in such a manner that by the first high speed agitation treatment, fine particles of triiron tetroxide are embedded in the surfaces of the fixable magnetic particles in an amount of 1 to 10% by weight based on the fixable magnetic particles and by the subsequent mixing treatment, fine particles of triiron tetroxide are blended with the fixable magnetic particles without being embedded therein in an amount of 1 to 20% by weight based on the fixable magnetic particles.

9. A process according to claim 6 wherein the dry blending is performed in one stage and the high speed agitation is stopped at the point when 1 to 10% by weight, based on the fixable magnetic particles, of fine particles of triiron tetroxide are embedded in the surfaces of the fixable magnetic particles and 1 to 20% by weight, based on the fixable magnetic particles, of fine particles of triiron tetroxide are not embedded in the surfaces of the fixable magnetic particles.

10. A composite magnetic developer as set forth in claim 1, wherein the amount of the fine particles of triiron tetroxide (C) is 1 to 5% by weight and the amount of the fine particles of triiron tetroxide (D) is 3 to 15% by weight, based on the fixable magnetic particles.

11. A composite magnetic developer as set forth in claim 4, wherein the amount of the binder medium (B) is 60 to 125% by weight, based on the fine particles of triiron tetroxide (A).

12. A composite magnetic developer for developing positively charged images as set forth in claim 5, wherein the binder medium comprises 1.6 to 160% by weight, based on the fine particles of triiron tetroxide (A), of the aromatic vinyl polymer, 0–50% by weight, based on the fine particles of triiron tetroxide (A) of the alicyclic resin or non-aromatic petroleum resin and 3.2 to 135% by weight, based on the fine particles of triiron tetroxide (A) of the polyolefin wax.

13. A composite magnetic developer as set forth in claim 1 wherein the fine particles (C) and (D) of triiron tetroxide have a weight average particle size smaller than 2 microns and a volume resistivity in the range of from $10^7$ Ω-cm to $10^{10}$ Ω-cm.

* * * * *